United States Patent [19]

Hsu et al.

[11] Patent Number: 4,518,004

[45] Date of Patent: May 21, 1985

[54] MULTIFUNCTION VALVE

[75] Inventors: William W. Hsu, Burbank; Manfred A. Runkel, Valencia, both of Calif.

[73] Assignee: HR Textron Inc., Valencia, Calif.

[21] Appl. No.: 553,601

[22] Filed: Nov. 21, 1983

[51] Int. Cl.[3] ..... F15B 13/04

[52] U.S. Cl. ..... 137/116; 91/420; 91/436; 91/446; 91/451; 137/596.12; 137/596.2

[58] Field of Search ..... 137/116, 596.12, 596.2, 137/106; 91/420, 436, 446, 451

[56] References Cited

U.S. PATENT DOCUMENTS

| | | | |
|---|---|---|---|
| 3,070,124 | 12/1962 | Fitzpatrick . | |
| 3,391,708 | 7/1968 | Rice . | |
| 3,587,393 | 6/1971 | Vick | 91/420 X |
| 3,613,715 | 10/1971 | Johnson . | |
| 3,707,984 | 1/1973 | Bantz . | |
| 3,942,550 | 3/1976 | Orme | 137/596.12 X |
| 3,960,166 | 6/1976 | Linser . | |
| 4,009,642 | 3/1977 | Vanderlaan | 137/106 X |
| 4,066,239 | 1/1978 | Hall . | |
| 4,087,967 | 5/1978 | Knapp . | |
| 4,191,202 | 3/1980 | Brent | 91/420 X |
| 4,433,615 | 2/1984 | Vick | 91/420 |
| 4,471,797 | 9/1984 | Cass et al. | 91/446 X |

*Primary Examiner*—Gerald A. Michalsky

*Attorney, Agent, or Firm*—Nilsson, Robbins, Dalgarn Berliner, Carson & Wurst

[57] ABSTRACT

A valve combining in a single unit a multiplicity of functions including isolation, thermal and pressure relief, return check and bypass. The valve includes a pair of spool valves, one slidably positioned within the other, disposed with a bore in a housing and interconnected with system pressure and return and an appropriate control valve.

5 Claims, 2 Drawing Figures

MULTIFUNCTION VALVE

BACKGROUND OF THE INVENTION

The present invention relates generally to valves and more particularly to a unitary valve capable of performing a multiplicity of functions.

The use of valves for controlling the application or flow of fluids under pressure are well developed in the industry. Such valves have many uses, among them, controlling the positions of various surfaces on aerospace vehicles, the positioning of various machines and parts thereof, as well as the control of various types of systems. The number and control functions which must be performed in fluid circuits by the associated valves is large and extremely diverse. As a result a correspondingly large and diverse number of different types of valves have been designed to meet the function demands in particular applications. The types of valves have ranged from exceedingly simple on/off valves to relatively complicated control valves.

In the prior art it has been customary to construct each valve separately in accordance with the particular function which is to be performed. That valve is then installed in the fluid system along with various other valves to complete the finished apparatus. The utilization of such a multiplicity of valves often leads to an apparatus which is relatively large and heavy and increases the overall complexity of the system, thereby reducing its reliability under many applications. In an attempt to meet these problems, others have provided kits consisting of valve parts which can be assembled thereby permitting a more simplified construction of valves having various functions. Examples of such prior art kits are shown in U.S. Pat. Nos. 3,613,715 and 3,960,166. Basically such kits include a housing, a sleeve and a spool with the housing and sleeve including ports therein for controlling fluid flow depending upon the type of spool inserted. Other types of prior art spool valves which are utilized to control fluid flow are shown in U.S. Pat. Nos. 3,070,124, 3,391,708, 3,707,984, 4,066,239 and 4,087,967.

SUMMARY OF THE INVENTION

A unitary valve adapted for positioning between a control valve and a source of fluid having pressure and return. The unitary valve includes a housing defining a bore within which is positioned a pair of spool valves, one positioned within a bore defined through the other. A pair of poppets are urged into contact with opposite ends of the bore through the other spool valve to thereby define a pair of chambers, one positioned on each side of the spool valve disposed within the bore through the other spool valve. Passageways are provided interconnecting the unitary valve with pressure and return from the fluid source and with the control valve so that upon the application of fluid under pressure, the poppets are retracted thereby providing fluid flow from the source, through the unitary valve, to the control valve.

As a further aspect of the present invention excessive load pressure is sensed by the spool valve positioned within the bore in the housing and as a result pressure is shunted to return thereby relieving the excessive load.

DETAILED DESCRIPTION

Figure 1:
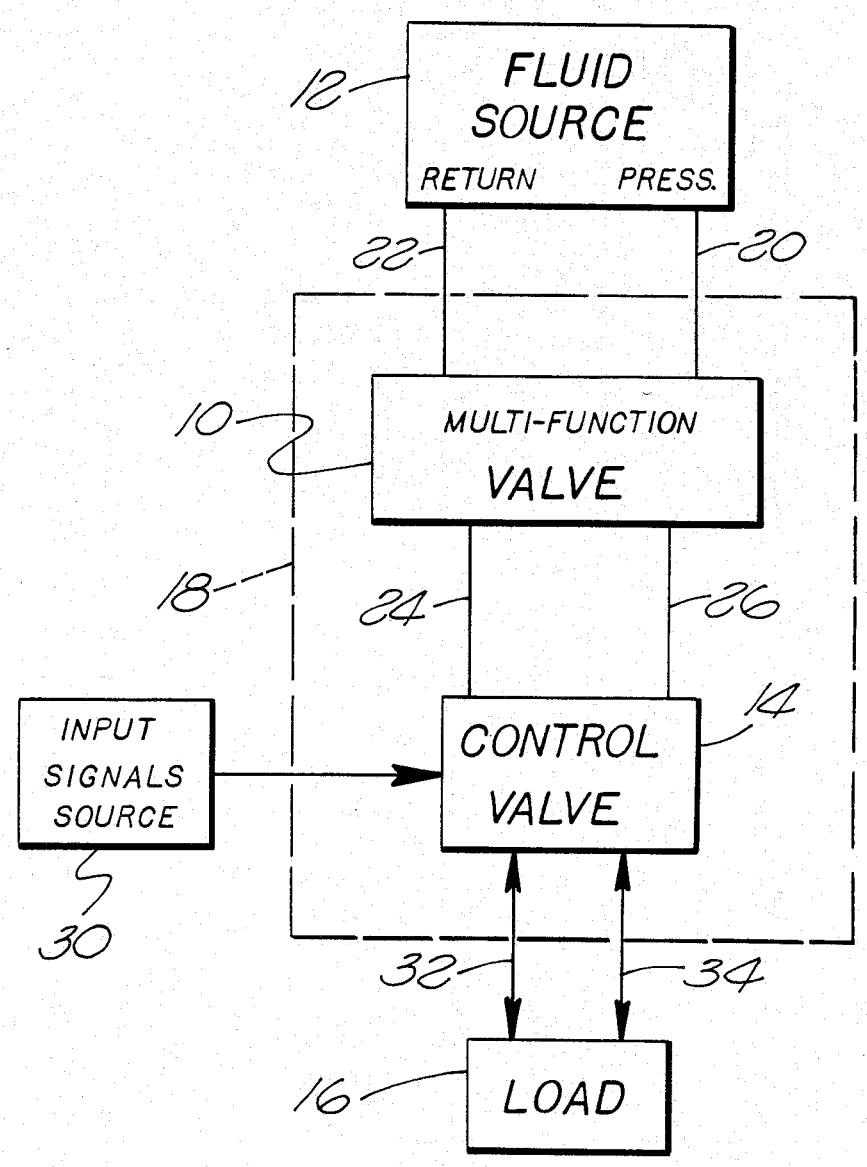
FIG. 1 is a block diagram schematically illustrating a multifunction valve in accordance with the present invention incorporated within a system to control the positioning of a load.

As is shown in FIG. 1 a multifunction valve 10 is positioned between a fluid source 12 and a control valve 14. The control valve 14 functions, as is well known in the art, to position a load 16 which is connected thereto responsive to signals from a source 30 thereof. The multifunction valve 10 may be encompassed in a separate housing or alternatively may be incorporated as a part of the housing within which the control valve is also positioned as is illustrated by the dashed line 18. In either event, the multifunction valve operates as a supply and return check valve, a load relief valve, a thermal relief valve, a bypass valve and a isolation valve as those functions are normally understood in control systems.

In the check valve mode of operation, the pressure and return from the fluid source 12 are applied by way of the passageways 20 and 22, respectively, to appropriate ports on the multifunction valve 10. Upon the application of the pressure and return appropriate poppets (as will be described more fully below) move to thereby apply the fluid source pressure and return to the control valve 14 as is shown by the passageways 24 and 26. Upon the application of pressure and return to the control valve 14, its positioning in response to input signals from a source 30 thereof causes the application of fluid pressure and return by way of the passageways 32 and 34 to the load 16 to appropriately position it in accordance with a particular application. The control valve load and input signal source as well as the fluid source may be of any type well known to the art and any of those may be utilized in conjunction with the multifunction valve 10 constructed in accordance with the principles of the present invention.

Figure 2:
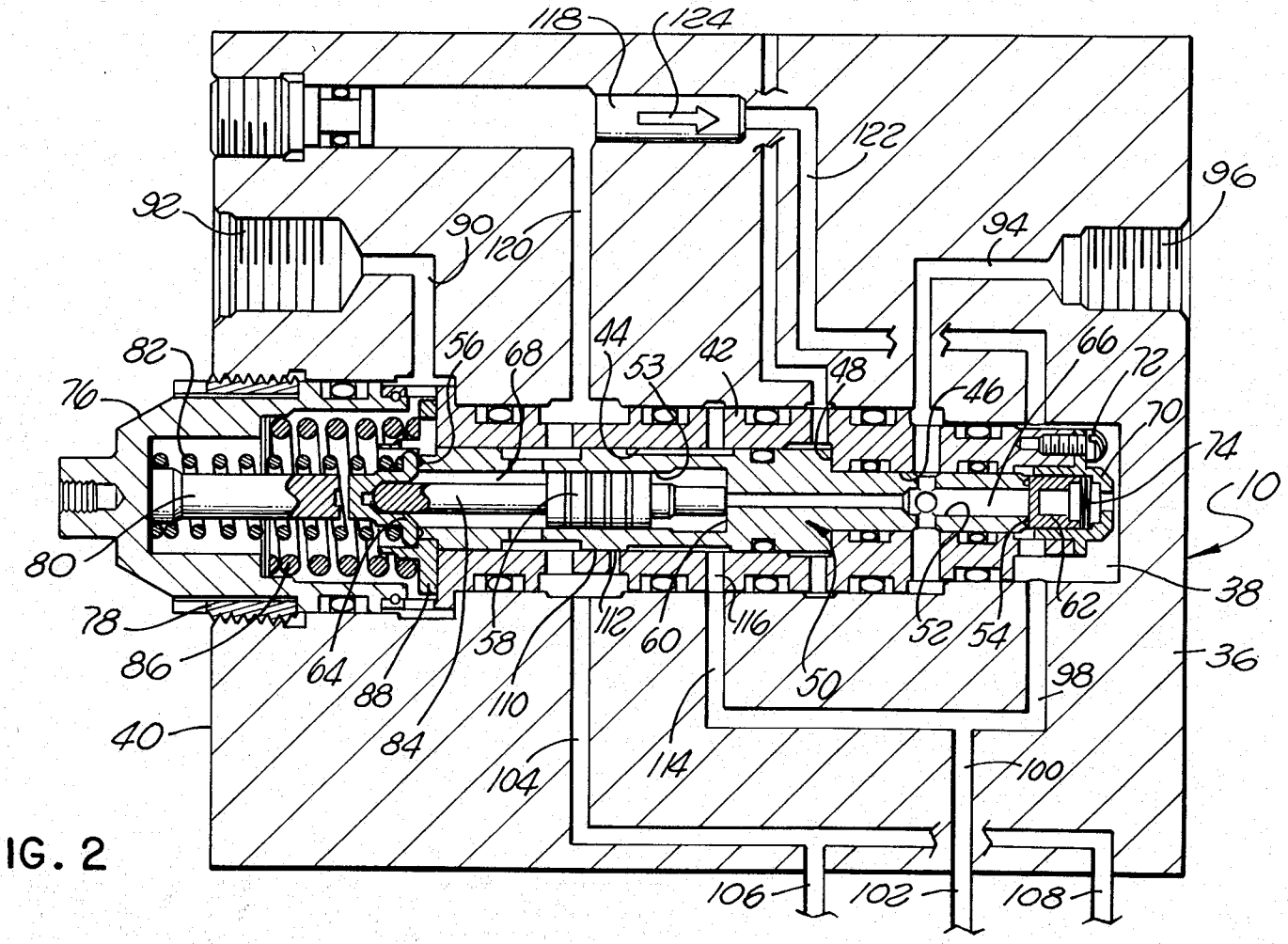
FIG. 2 is a schematic diagram in cross section illustrating the multifunction valve of the present invention.

Referring now more particularly to FIG. 2, the multifunction valve constructed in accordance with the present invention is illustrated more in detail but in schematic representation. As is therein shown the multifunction valve 10 includes a housing 36 defining a bore 38 which extends therein from the surface 40. Disposed within the bore 38 is a stationary sleeve 42 defining appropriate ports as will be more fully described below. The sleeve 42 also defines a bore 44 which has a reduced diameter portion 46 defining a shoulder 48. Slidably positioned within the bore 44 is a spool valve 50 which also defines a bore shown generally at 52 extending completely therethrough. The spool valve 50 has first and second ends 54 and 56, respectively. Positioned within the bore 52 defined by the spool valve 50 is a second spool valve 58. As is noted the spool valve 58 is positioned within an enlarged diameter portion 53 of the bore 52 which defines a shoulder 60.

First and second poppets 62 and 64 are urged against the ends 54 and 56, respectively, of the spool 50 thereby closing the ends thereof and in conjunction with the spool valve 58 defining first and second chambers 66 and 68.

The poppet 62 is retained in position adjacent the end 54 of the spool 50 by way of a cap 70 which is secured upon the sleeve 42 by appropriate fastening devices such as bolts 72. A spring means 74 is received within the cap 70 and bears at one end against the cap 70 and at the other against the poppet 62 thereby urging the poppet toward the end 54 of the spool 50. In this manner, the end 54 of the spool 50 is closed thereby forming the chamber 66.

The bore 38 is closed at the surface 40 of the housing 36 by a cap 76 which is held in place by an appropriate threaded fastener such as illustrated at 78. As is illustrated the cap is hollow and includes a rod 80 extending therefrom to define a stop means. Positioned around the rod 80 is a spring 82 which is retained at one end against the cap 76 and at the opposite end against the poppet 64, thereby urging the poppet 64 against the end 56 of the spool 50 thereby sealing or closing the same and forming the chamber 68 as above described. It should also be noted that the spool 58 includes a rod 84 extending therefrom and engaging the poppet 64 for a purpose that will be described below.

Also positioned within the hollow cap 76 is an additional spring 86 which abuts a flange 88 which in turn is seated against the spool 50. A passageway 90 extends from a port 92 which is adapted for connection to fluid source 12 return thereby connecting the return portion of the fluid source to the poppet 64.

A passageway 94 connects the chamber 66 to a port 96 which is adapted for connection to fluid source 12 pressure. Therefore, upon application of the fluid source 12 pressure to the port 96 it is in turn connected to the chamber 66 and to the first poppet 62.

SUPPLY AND RETURN CHECK VALVE FUNCTION

Upon the application of fluid source 12 pressure to the port 96, the same is also applied simultaneously to the chamber 66. Upon application of fluid pressure to the chamber 66 (since the chamber 66 is isolated by the spool 58 from the remainder of the system) force is applied to the first poppet 62 urging it away from the end 54 of the spool 50 and against the force of the spring 74. When the poppet 62 moves toward the right as viewed in FIG. 2, fluid under pressure then flows from the chamber 66 into the bore 38 and by way of the passageways 98 and 100 to the port 102 for application to the control valve 14. At the same time, the fluid pressure moves the spool 58 toward the left as viewed in FIG. 2 causing the rod 84 to urge the second poppet 64 toward the left against the force of the spring 82 until it engages the end of the rod 80. As a result thereof the end 56 of the spool 50 is open and fluid source 12 return is connected by the port 92 and the passageway 90 through the end 56 of the spool 50 and the chamber 68 to the passageway 104 which in turn is connected to the ports 106 and 108 and from them to the control valve 14. It can thus by seen that by the application of fluid source 12 pressure the poppets 62 and 64 are urged away from their closed positions and into their open positions thereby connecting system pressure and return to the control valve. If there is a loss of system pressure the springs 74 and 82 immediately urge the poppets 62 and 64, respectively, back into the closed position as illustrated thereby eliminating loss of fluid from the system downstream of the multifunction valve 10.

LOAD RELIEF AND THERMAL RELIEF FUNCTION

From time to time forces applied to the load 16 (as shown in FIG. 1) are reflected by increased pressure in the system. Alternatively, the system may be subjected to heat which in turn causes pressure in the fluid to increase beyond preset limits. It is desirable, in either case, to relieve this pressure to preclude possible damage to the load or the system from excessive forces being applied thereto. The multifunction valve constructed in accordance with the present invention provides such excess pressure relief.

Assume that system pressure and return has been applied and that the poppets 62 and 64 are in their extended positions as above described. Also assume that excess heat is present or that a force has been applied to the load in such a manner that excess pressure now exists within the passageway 98 and thus is also experienced within the bore 38. Such increased pressure will be applied against the end 54 of the spool valve 50. The spool valve 58 has been extended toward the left thus removing any constraints on movement by the spool 50 as a result of the spool 58 and the spring 82. It will, however, be noted that the spring 86 does abut the flange 88 which in turn abuts the spool valve 50. If the pressure appearing in the bore 38 and against the end 54 of the spool 50 generates a force in excess of the force applied by the spring 86, the spool valve 50 will move toward the left. When the spool valve 50 moves toward the left a land 110 will move toward the left and will open the port 112 appearing in the sleeve 42. When such is done the pressure appearing in the bore 38 is transmitted through the passageways 100, 114, the port 116 and the port 112 to system return, thereby relieving the pressure. Upon release of the pressure as above described, the spring 86 returns spool valve 50 to the position shown, thereby closing the port 112. If the pressure again builds up the process will be repeated. The process will be continuously repeated until such a time as the pressure generated as a result of the application of the excessive load or temperature disappears.

BYPASS FUNCTION

From time to time when system pressure is not applied but the fluid is within the system, including the load and the control valve, forces may be applied to the load which will generate pressures that should be dissipated to preclude damage to the load. Such is provided by the multifunction valve constructed in accordance with the present invention. As is illustrated in FIG. 2 a check valve 118 is connected by way of passageways 120 and 122 between return and pressure passageways of the control valve and load as is illustrated. Under these circumstances, if sufficient pressure is generated in the return system of the control valve and load combination it will flow from the return portion of the system to the pressure portion of the system through the one-way check valve 118 as is illustrated by the arrow 124. If pressure is applied to the system in the opposite direction it will be recognized by those skilled in the art that relief therefrom may be accomplished as above described in conjunction with the load release function of the valve as above described with the forces, in this instance, being applied against the poppet 62 through the inner portion of the hollow cap 70 and the opening provided therein.

THE ISOLATION VALVE FUNCTION

From the above description it should be understood by those skilled in the art that although system pressure and return are applied to the control valve and subsequently to the load through the same multifunction valve, the system pressure and return are maintained isolated from each other at all times except during load pressure overload. Such isolation is maintained through the utilization of the spool valves 50 and 58 as well as the check valve 118 to maintain the system pressure and return flow paths isolated from each other. That is, the two chambers 68 and 66 are prevented from communicating with each other through the interaction of the spool valve 58 within the bore 52 and the spool valve 50 within the bore 44 of the sleeve 42.

ASSEMBLY OF THE VALVE

Those skilled in the art will recognize that through the simple construction of the multifunction valve in accordance with the principles of the present invention a relatively simple and easy valve by way of construction and maintenance is provided. As can be seen the spool valve 58 may be inserted within the bore within the spool valve 50. Thereafter the spool valve 50 may be inserted within the bore of the sleeve 42. Subsequently the poppet 62, spring 74 and cap 70 are affixed and fastened by the bolt 72 to the sleeve 42. Thereafter the subassembly of the sleeve, the two spool valves and the first poppet and retaining cap and spring are inserted into the bore 38 after which the flange 88, poppet 64 and springs 86 and 82 are positioned and then held in place by the cap 76 and the retaining cylinder 78. Obviously, the valve may be disassembled for maintenance and repair by a reversal of the procedures above briefly described.

Those skilled in the art will recognize that a simple, easy to construct and maintain valve has been provided which is capable of performing a multiplicity of functions normally performed by a plurality of valves. Through this construction a substantial decrease in weight can be experienced along with an increase in reliability and reduced cost and ease of maintenance.

What is claimed is:

1. In a hydraulic control circuit for providing flow of fluid under pressure between a source and return thereof to a load responsive to positioning of a control valve the improvement of a combination valve means in a unitary housing interposed between said control valve and said source/return for providing a plurality of functions normally provided by a plurality of separate valves, said valve means comprising:

(A) a housing defining a first bore therein;

(B) a first spool valve having lands and grooves slidably disposed within said first bore and defining a second bore therein;

(C) a second spool valve reciprocally disposed within said second bore and closing said second bore at a first position;

(D) a first poppet means disposed adjacent one end of said second bore and urged thereagainst to close said second bore at a second position displaced from said first position thereby defining a first closed chamber within said first spool valve between said first poppet and said second spool valve;

(E) first passageway means for connecting said fluid pressure source to said first closed chamber;

(F) a second poppet means disposed adjacent the opposite end of said second bore and urged thereagainst to close said opposite end of said second bore thereby defining a second closed chamber within said first spool valve between said second spool valve and said second poppet, said second spool valve engaging said second poppet means;

(G) second passageway means for connecting said return to said second poppet means;

(H) third and fourth passageway means for connecting said first poppet and said second chamber to said control valve;

(I) said first and second poppets normally blocking communication of said third and fourth passageways with said first and second passageways respectively in the absence of said fluid under pressure and permitting communication therebetween upon the application of fluid under pressure to said first chamber.

2. The valve means as defined in claim 1 which further includes first and second spring means urging said first and second poppets into engagement with said first spool valve.

3. The valve means as defined in claim 2 wherein said first bore includes an enlarged diameter portion defining a shoulder therein and said first spool seats against said shoulder and which further includes third spring means urging said first spool into engagement with said shoulder.

4. The valve means as defined in claim 3 which further includes port means communicating between said third and fourth passageways, a land on said first spool valve normally closing said port means to thereby block said communication.

5. The valve means as defined in claim 3 wherein said second spool valve slides in said second bore upon application of system pressure thereto and moves said second poppet against said second spring means and thereby opens said opposite end of said second bore.

* * * * *

UNITED STATES PATENT AND TRADEMARK OFFICE

CERTIFICATE OF CORRECTION

PATENT NO. : 4,518,004

DATED : May 21, 1985

INVENTOR(S) : William W. Hsu et al

It is certified that error appears in the above-identified patent and that said Letters Patent is hereby corrected as shown below:

In the (Grant Only) Patent No. 4,518,009 bearing columns 1-6 should be deleted to be replaced with Patent No. 4,518,004 bearing columns 1-6 as shown on the attached sheets.

Signed and Sealed this

Seventeenth Day of February, 1987

*Attest:*

DONALD J. QUIGG

*Attesting Officer*

*Commissioner of Patents and Trademarks*

MULTIFUNCTION VALVE

BACKGROUND OF THE INVENTION

The present invention relates generally to valves and more particularly to a unitary valve capable of performing a multiplicity of functions.

The use of valves for controlling the application or flow of fluids under pressure are well developed in the industry. Such valves have many uses, among them, controlling the positions of various surfaces on aerospace vehicles, the positioning of various machines and parts thereof, as well as the control of various types of systems. The number and control functions which must be performed in fluid circuits by the associated valves is large and extremely diverse. As a result a correspondingly large and diverse number of different types of valves have been designed to meet the function demands in particular applications. The types of valves have ranged from exceedingly simple on/off valves to relatively complicated control valves.

In the prior art it has been customary to construct each valve separately in accordance with the particular function which is to be performed. That valve is then installed in the fluid system along with various other valves to complete the finished apparatus. The utilization of such a multiplicity of valves often leads to an apparatus which is relatively large and heavy and increases the overall complexity of the system, thereby reducing its reliability under many applications. In an attempt to meet these problems, others have provided kits consisting of valve parts which can be assembled thereby permitting a more simplified construction of valves having various functions. Examples of such prior art kits are shown in U.S. Pat. Nos. 3,613,715 and 3,960,166. Basically such kits include a housing, a sleeve and a spool with the housing and sleeve including ports therein for controlling fluid flow depending upon the type of spool inserted. Other types of prior art spool valves which are utilized to control fluid flow are shown in U.S. Pat. Nos. 3,070,124, 3,391,708, 3,707,984, 4,066,239 and 4,087,967.

SUMMARY OF THE INVENTION

A unitary valve adapted for positioning between a control valve and a source of fluid having pressure and return. The unitary valve includes a housing defining a bore within which is positioned a pair of spool valves, one positioned within a bore defined through the other. A pair of poppets are urged into contact with opposite ends of the bore through the other spool valve to thereby define a pair of chambers, one positioned on each side of the spool valve disposed within the bore through the other spool valve. Passageways are provided interconnecting the unitary valve with pressure and return from the fluid source and with the control valve so that upon the application of fluid under pressure, the poppets are retracted thereby providing fluid flow from the source, through the unitary valve, to the control valve.

As a further aspect of the present invention excessive load pressure is sensed by the spool valve positioned within the bore in the housing and as a result pressure is shunted to return thereby relieving the excessive load.

BRIEF DESCRIPTION OF THE DRAWINGS

FIG. 1 is a block diagram schematically illustrating a multifunction valve in accordance with the present invention incorporated within a system to control the positioning of a load; and FIG. 2 is a schematic diagram in cross section illustrating the multifunction valve of the present invention.

DETAILED DESCRIPTION

As is shown in FIG. 1 a multifunction valve 10 is positioned between a fluid source 12 and a control valve 14. The control valve 14 functions, as is well known in the art, to position a load 16 which is connected thereto responsive to signals from a source 30 thereof. The multifunction valve 10 may be encompassed in a separate housing or alternatively may be incorporated as a part of the housing within which the control valve is also positioned as is illustrated by the dashed line 18. In either event, the multifunction valve operates as a supply and return check valve, a load relief valve, a thermal relief valve, a bypass valve and a isolation valve as those functions are normally understood in control systems.

In the check valve mode of operation, the pressure and return from the fluid source 12 are applied by way of the passageways 20 and 22, respectively, to appropriate ports on the multifunction valve 10. Upon the application of the pressure and return appropriate poppets (as will be described more fully below) move to thereby apply the fluid source pressure and return to the control valve 14 as is shown by the passageways 24 and 26. Upon the application of pressure and return to the control valve 14, its positioning in response to input signals from a source 30 thereof causes the application of fluid pressure and return by way of the passageways 32 and 34 to the load 16 to appropriately position it in accordance with a particular application. The control valve load and input signal source as well as the fluid source may be of any type well known to the art and any of those may be utilized in conjunction with the multifunction valve 10 constructed in accordance with the principles of the present invention.

Referring now more particularly to FIG. 2, the multifunction valve constructed in accordance with the present invention is illustrated more in detail but in schematic representation. As is therein shown the multifunction valve 10 includes a housing 36 defining a bore 38 which extends therein from the surface 40. Disposed within the bore 38 is a stationary sleeve 42 defining appropriate ports as will be more fully described below. The sleeve 42 also defines a bore 44 which has a reduced diameter portion 46 defining a shoulder 48. Slidably positioned within the bore 44 is a spool valve 50 which also defines a bore shown generally at 52 extending completely therethrough. The spool valve 50 has first and second ends 54 and 56, respectively. Positioned within the bore 52 defined by the spool valve 50 is a second spool valve 58. As is noted the spool valve 58 is positioned within an enlarged diameter portion 53 of the bore 52 which defines a shoulder 60.

First and second poppets 62 and 64 are urged against the ends 54 and 56, respectively, of the spool 50 thereby closing the ends thereof and in conjunction with the spool valve 58 defining first and second chambers 66 and 68.

The poppet 62 is retained in position adjacent the end 54 of the spool 50 by way of a cap 70 which is secured upon the sleeve 42 by appropriate fastening devices such as bolts 72. A spring means 74 is received within the cap 70 and bears at one end against the cap 70 and at the other against the poppet 62 thereby urging the poppet toward the end 54 of the spool 50. In this manner, the end 54 of the spool 50 is closed thereby forming the chamber 66.

The bore 38 is closed at the surface 40 of the housing 36 by a cap 76 which is held in place by an appropriate threaded fastener such as illustrated at 78. As is illustrated the cap is hollow and includes a rod 80 extending therefrom to define a stop means. Positioned around the rod 80 is a spring 82 which is retained at one end against the cap 76 and at the opposite end against the poppet 64, thereby urging the poppet 64 against the end 56 of the spool 50 thereby sealing or closing the same and forming the chamber 68 as above described. It should also be noted that the spool 58 includes a rod 84 extending therefrom and engaging the poppet 64 for a purpose that will be described below.

Also positioned within the hollow cap 76 is an additional spring 86 which abuts a flange 88 which in turn is seated against the spool 50. A passageway 90 extends from a port 92 which is adapted for connection to fluid source 12 return thereby connecting the return portion of the fluid source to the poppet 64.

A passageway 94 connects the chamber 66 to a port 96 which is adapted for connection to fluid source 12 pressure. Therefore, upon application of the fluid source 12 pressure to the port 96 it is in turn connected to the chamber 66 and to the first poppet 62.

SUPPLY AND RETURN CHECK VALVE FUNCTION

Upon the application of fluid source 12 pressure to the port 96, the same is also applied simultaneously to the chamber 66. Upon application of fluid pressure to the chamber 66 (since the chamber 66 is isolated by the spool 58 from the remainder of the system) force is applied to the first poppet 62 urging it away from the end 54 of the spool 50 and against the force of the spring 74. When the poppet 62 moves toward the right as viewed in FIG. 2, fluid under pressure then flows from the chamber 66 into the bore 38 and by way of the passageways 98 and 100 to the port 102 for application to the control valve 14. At the same time, the fluid pressure moves the spool 58 toward the left as viewed in FIG. 2 causing the rod 84 to urge the second poppet 64 toward the left against the force of the spring 82 until it engages the end of the rod 80. As a result thereof the end 56 of the spool 50 is open and fluid source 12 return is connected by the port 92 and the passageway 90 through the end 56 of the spool 50 and the chamber 68 to the passageway 104 which in turn is connected to the ports 106 and 108 and from them to the control valve 14. It can thus by seen that by the application of fluid source 12 pressure the poppets 62 and 64 are urged away from their closed positions and into their open positions thereby connecting system pressure and return to the control valve. If there is a loss of system pressure the springs 74 and 82 immediately urge the poppets 62 and 64, respectively, back into the closed position as illustrated thereby eliminating loss of fluid from the system downstream of the multifunction valve 10.

LOAD RELIEF AND THERMAL RELIEF FUNCTION

From time to time forces applied to the load 16 (as shown in FIG. 1) are reflected by increased pressure in the system. Alternatively, the system may be subjected to heat which in turn causes pressure in the fluid to increase beyond preset limits. It is desirable, in either case, to relieve this pressure to preclude possible damage to the load or the system from excessive forces being applied thereto. The multifunction valve constructed in accordance with the present invention provides such excess pressure relief.

Assume that system pressure and return has been applied and that the poppets 62 and 64 are in their extended positions as above described. Also assume that excess heat is present or that a force has been applied to the load in such a manner that excess pressure now exists within the passageway 98 and thus is also experienced within the bore 38. Such increased pressure will be applied against the end 54 of the spool valve 50. The spool valve 58 has been extended toward the left thus removing any constraints on movement by the spool 50 as a result of the spool 58 and the spring 82. It will, however, be noted that the spring 86 does abut the flange 88 which in turn abuts the spool valve 50. If the pressure appearing in the bore 38 and against the end 54 of the spool 50 generates a force in excess of the force applied by the spring 86, the spool valve 50 will move toward the left. When the spool valve 50 moves toward the left a land 110 will move toward the left and will open the port 112 appearing in the sleeve 42. When such is done the pressure appearing in the bore 38 is transmitted through the passageways 100, 114, the port 116 and the port 112 to system return, thereby relieving the pressure. Upon release of the pressure as above described, the spring 86 returns spool valve 50 to the position shown, thereby closing the port 112. If the pressure again builds up the process will be repeated. The process will be continuously repeated until such a time as the pressure generated as a result of the application of the excessive load or temperature disappears.

BYPASS FUNCTION

From time to time when system pressure is not applied but the fluid is within the system, including the load and the control valve, forces may be applied to the load which will generate pressures that should be dissipated to preclude damage to the load. Such is provided by the multifunction valve constructed in accordance with the present invention. As is illustrated in FIG. 2 a check valve 118 is connected by way of passageways 120 and 122 between return and pressure passageways of the control valve and load as is illustrated. Under these circumstances, if sufficient pressure is generated in the return system of the control valve and load combination it will flow from the return portion of the system to the pressure portion of the system through the one-way check valve 118 as is illustrated by the arrow 124. If pressure is applied to the system in the opposite direction it will be recognized by those skilled in the art that relief therefrom may be accomplished as above described in conjunction with the load release function of the valve as above described with the forces, in this instance, being applied against the poppet 62 through the inner portion of the hollow cap 70 and the opening provided therein.

THE ISOLATION VALVE FUNCTION

From the above description it should be understood by those skilled in the art that although system pressure and return are applied to the control valve and subsequently to the load through the same multifunction valve, the system pressure and return are maintained isolated from each other at all times except during load pressure overload. Such isolation is maintained through the utilization of the spool valves 50 and 58 as well as the check valve 118 to maintain the system pressure and return flow paths isolated from each other. That is, the two chambers 68 and 66 are prevented from communicating with each other through the interaction of the spool valve 58 within the bore 52 and the spool valve 50 within the bore 44 of the sleeve 42.

ASSEMBLY OF THE VALVE

Those skilled in the art will recognize that through the simple construction of the multifunction valve in accordance with the principles of the present invention a relatively simple and easy valve by way of construction and maintenance is provided. As can be seen the spool valve 58 may be inserted within the bore within the spool valve 50. Thereafter the spool valve 50 may be inserted within the bore of the sleeve 42. Subsequently the poppet 62, spring 74 and cap 70 are affixed and fastened by the bolt 72 to the sleeve 42. Thereafter the subassembly of the sleeve, the two spool valves and the first poppet and retaining cap and spring are inserted into the bore 38 after which the flange 88, poppet 64 and springs 86 and 82 are positioned and then held in place by the cap 76 and the retaining cylinder 78. Obviously, the valve may be disassembled for maintenance and repair by a reversal of the procedures above briefly described.

Those skilled in the art will recognize that a simple, easy to construct and maintain valve has been provided which is capable of performing a multiplicity of functions normally performed by a plurality of valves. Through this construction a substantial decrease in weight can be experienced along with an increase in reliability and reduced cost and ease of maintenance.

What is claimed is:

1. In a hydraulic control circuit for providing flow of fluid under pressure between a source and return thereof to a load responsive to positioning of a control valve the improvement of a combination valve means in a unitary housing interposed between said control valve and said source/return for providing a plurality of functions normally provided by a plurality of separate valves, said valve means comprising:

(A) a housing defining a first bore therein;

(B) a first spool valve having lands and grooves slidably disposed within said first bore and defining a second bore therein;

(C) a second spool valve reciprocally disposed within said second bore and closing said second bore at a first position;

(D) a first poppet means disposed adjacent one end of said second bore and urged thereagainst to close said second bore at a second position displaced from said first position thereby defining a first closed chamber within said first spool valve between said first poppet and said second spool valve;

(E) first passageway means for connecting said fluid pressure source to said first closed chamber;

(F) a second poppet means disposed adjacent the opposite end of said second bore and urged thereagainst to close said opposite end of said second bore thereby defining a second closed chamber within said first spool valve between said second spool valve and said second poppet, said second spool valve engaging said second poppet means;

(G) second passageway means for connecting said return to said second poppet means;

(H) third and fourth passageway means for connecting said first poppet and said second chamber to said control valve;

(I) said first and second poppets normally blocking communication of said third and fourth passageways with said first and second passageways respectively in the absence of said fluid under pressure and permitting communication therebetween upon the application of fluid under pressure to said first chamber.

2. The valve means as defined in claim 1 which further includes first and second spring means urging said first and second poppets into engagement with said first spool valve.

3. The valve means as defined in claim 2 wherein said first bore includes an enlarged diameter portion defining a shoulder therein and said first spool seats against said shoulder and which further includes third spring means urging said first spool into engagement with said shoulder.

4. The valve means as defined in claim 3 which further includes port means communicating between said third and fourth passageways, a land on said first spool valve normally closing said port means to thereby block said communication.

5. The valve means as defined in claim 3 wherein said second spool valve slides in said second bore upon application of system pressure thereto and moves said second poppet against said second spring means and thereby opens said opposite end of said second bore.

* * * * *